US008816609B2

(12) United States Patent
Zhang et al.

(10) Patent No.: US 8,816,609 B2
(45) Date of Patent: Aug. 26, 2014

(54) METHOD AND CIRCUIT FOR IMPROVING CREST FACTOR OF GAS DISCHARGE LAMP

(75) Inventors: Qi Zhang, Shanghai (CN); Weiqiang Zhang, Shanghai (CN); Jianping Ying, Shanghai (CN)

(73) Assignee: Delta Electronics (Shanghai) Co., Ltd., Shanghai (CN)

( * ) Notice: Subject to any disclaimer, the term of this patent is extended or adjusted under 35 U.S.C. 154(b) by 193 days.

(21) Appl. No.: 13/533,671

(22) Filed: Jun. 26, 2012

(65) Prior Publication Data

US 2013/0020966 A1 Jan. 24, 2013

(30) Foreign Application Priority Data

Jul. 19, 2011 (CN) ..... 2011 1 0201429

(51) Int. Cl.

| | |
|---|---|
| ***G05F 1/00*** | (2006.01) |
| ***H05B 37/02*** | (2006.01) |
| ***H05B 39/04*** | (2006.01) |
| ***H05B 41/36*** | (2006.01) |
| ***H05B 41/285*** | (2006.01) |
| *H05B 39/02* | (2006.01) |
| *H05B 41/16* | (2006.01) |
| *H05B 41/24* | (2006.01) |
| *H01J 13/48* | (2006.01) |
| *H01J 15/04* | (2006.01) |
| *H01J 17/36* | (2006.01) |
| *H05B 37/00* | (2006.01) |
| *H05B 39/00* | (2006.01) |
| *H05B 41/00* | (2006.01) |
| *H05B 41/282* | (2006.01) |

(52) U.S. Cl.

CPC ..... *H05B 41/2858* (2013.01); *H05B 41/2828* (2013.01)

USPC ..... 315/307; 315/209 R; 315/246; 315/326

(58) Field of Classification Search

None

See application file for complete search history.

(56) References Cited

U.S. PATENT DOCUMENTS

| | | | | |
|---|---|---|---|---|
| 5,907,223 | A * | 5/1999 | Gu et al. | 315/247 |
| 6,552,498 | B1 * | 4/2003 | Prasad et al. | 315/244 |
| 7,378,806 | B2 * | 5/2008 | Nerone | 315/291 |
| 7,439,690 | B2 * | 10/2008 | Fukuwa | 315/308 |

FOREIGN PATENT DOCUMENTS

| | | | |
|---|---|---|---|
| CN | 1156200 | A | 8/1997 |
| CN | 101352107 | A | 1/2009 |

* cited by examiner

*Primary Examiner* — Douglas W Owens
*Assistant Examiner* — Dedei K Hammond
(74) *Attorney, Agent, or Firm* — Morris Manning & Martin LLP; Tim Tingkang Xia, Esq.

(57) ABSTRACT

A method and circuit for improving the crest factor of the gas discharge lamp. The method includes: the signal of the gas discharge lamp can be sampled to get a status signal; whether the present stage of the gas discharge lamp is at warm up stage or constant power stage can be judged based on the result of comparison between the status signal and a preset value; preset parameters can be selected based on the stage of the gas discharge lamp, the first parameter can be selected when the gas discharge lamp is at a warm up stage, and the second parameter can be selected when the gas discharge lamp is at a constant power stage; a control signal can be outputted during the lamp current commutation based on the selected first or second parameter to improve the crest factor of the gas discharge lamp.

16 Claims, 8 Drawing Sheets

METHOD AND CIRCUIT FOR IMPROVING CREST FACTOR OF GAS DISCHARGE LAMP

CROSS-REFERENCE TO RELATED APPLICATIONS

This non-provisional application claims priority under 35 U.S.C. §119(a) on Patent Application No. 201110201429.3 filed in P.R. China on Jul. 19, 2011, the entire contents of which are hereby incorporated by reference.

FIELD OF INVENTION

The invention relates to a technology for improving the crest factor (CF) of the gas discharge lamp, particularly, it relates to a method and circuit for improving the crest factor of the gas discharge lamp by decreasing the peak current of the gas discharge lamp during the lamp current commutation.

BACKGROUND

The principle of a traditional gas discharge lamp is shown in FIG. 1. Referring to FIG. 1, the circuit of a traditional gas discharge lamp comprises mainly a power factor correction circuit 10, a DC/DC converter 12, and an inverter 14. Those three can be connected in sequence, and the output of the inverter 14 can be connected with the gas discharge lamp 16.

As shown in FIG. 1, suitable power energy can be provided by the DC/DC converter 12 to the gas discharge lamp, and square wave voltage signal of low frequency (for example, 150 Hz) can be provided by the inverter 14 to the gas discharge lamp, these are the prior art and will not be further described herein.

The crest factor (a ratio of the peak current to the RMS current of the gas discharge lamp) is one of the parameters of the gas discharge lamp, and the crest factor is a significant parameter, which affects the life of the gas discharge lamp. Under an ideal condition, the value of the crest factor is one. However, since the peak current is usually larger than the RMS current in the practical application, the value of the crest factor may be larger than one in the practical application.

The larger the value of the crest factor is, the larger the peak current is, and this will cause the electrodes of the gas discharge lamp to be destroyed thereby cause the life of the gas discharge lamp to be decreased. Thus, in the gas discharge lamp circuit, an auxiliary circuit will be designed to reduce the peak current and to control the crest factor and to allow its value to be near an ideal value.

SUMMARY

A method and circuit for improving the crest factor of the gas discharge lamp are disclosed to improve the crest factor during the application procedure of the gas discharge lamp or to extend the life of the gas discharge lamp.

One embodiment of the invention provides a gas discharge lamp circuit in which the crest factor has been improved.

Another embodiment of the invention provides another discharge lamp circuit in which the crest factor has been improved.

The disclosed technical scheme is: a method for improving the crest factor of the gas discharge lamp, it comprises:

step 1: the decision signal of the gas discharge lamp will be sampled to get a status signal;

step 2: whether the present stage of the gas discharge lamp is at a warm up stage or a constant power stage can be judged based on the result of comparison between the said status signal and a preset value;

step 3: preset parameters can be selected based on the stage of the gas discharge lamp, the first parameter can be selected when the gas discharge lamp is at a warm up stage, and the second parameter can be selected when the gas discharge lamp is at a constant power stage;

step 4: a control signal can be outputted during the lamp current commutation based on the selected first or second parameter to improve the crest factor of the gas discharge lamp.

According to an embodiment of a method for improving the crest factor of the gas discharge lamp in the invention, said status signal is a signal reflecting the lamp state or a signal reflecting the lamp power.

According to an embodiment of a method for improving the crest factor of the gas discharge lamp in the invention, said signal reflecting the lamp state is one of lamp voltage and duty cycle of the ballast driver, or said signal reflecting the lamp power is one of the lamp power of the gas discharge lamp, system input power and system output power.

According to an embodiment of a method for improving the crest factor of the gas discharge lamp in the invention, step 4 comprises:

outputting the second or the third current given signal based on the selected first or second parameter;

holding the status of outputting the second or third current given signal for the duration of the selected first or second parameter;

outputting the first current given signal when the duration of the first parameter or the second parameter is over.

According to an embodiment of a method for improving the crest factor of the gas discharge lamp in the invention, step 4 comprises:

outputting the second or the third current feedback signal based on the selected first or second parameter;

holding the status of outputting the second or the third current feedback signal for duration of the selected first or second parameter;

outputting the first current feedback signal when the duration of the selected first or second parameter is over.

According to an embodiment of a method for improving the crest factor of the gas discharge lamp in the invention, step 4 comprises:

disabling the DC/DC converter in the gas discharge lamp circuit;

holding the DC/DC converter disabled for duration of the selected first or second parameter;

enabling the DC/DC converter when the duration of disabling the DC/DC converter is over.

According to an embodiment of a method for improving the crest factor of the gas discharge lamp in the invention, wherein the result of comparison between the said status signal and the preset value is a count signal of a counter.

A gas discharge lamp circuit with improved crest factor is also disclosed in the invention, wherein it comprises a DC/DC converter, an inverter, a decision signal sample circuit, a digital process chip and a control unit, wherein:

the current or power of the gas discharge lamp can be controlled by the DC/DC converter;

the inversion of the direct current to the alternating current can be performed by said inverter, which is coupled to said DC/DC converter;

the signal of the gas discharge lamp can be sampled by the decision signal sample circuit which outputs a status signal;

whether the present state of the gas discharge lamp is at the warm up stage or the constant power stage can be judged by the digital process chip, which is coupled to the decision signal sample circuit, based on the result of comparison between the status signal and a preset value, and the first parameter can be selected when the gas discharge lamp is at a warm up stage, and the second parameter can be selected when the gas discharge lamp is at a constant power stage, and a corresponding control signal can be outputted to the control unit during the current commutation based on the selected first or second parameter;

the crest factor of the gas discharge lamp can be improved by the control unit which is coupled to the digital process chip.

According to an embodiment of the gas discharge lamp circuit with improved crest factor in the invention, it comprises a power factor correction circuit, different input alternating voltages can be converted to constant or variable direct current by the power factor correction circuit, the output of the power factor correction circuit can be coupled to the input of DC/DC converter.

According to an embodiment of the gas discharge lamp circuit with improved crest factor in the invention, the status signal is a signals reflecting the lamp state or a signal reflecting the lamp power.

According to an embodiment of the gas discharge lamp circuit with improved crest factor in the invention, the said status signal is the signal reflecting the output voltage of said DC/DC converter.

According to an embodiment of the gas discharge lamp circuit with improved crest factor in the invention, the digital process chip comprises a stage judging unit, a parameter selection unit and a control signal output unit, wherein:

whether the present state of the gas discharge lamp is at the warm up stage or the constant power stage can be decided by the stage judging unit based on the result of comparison between the status signal and the preset value;

the parameter selection unit is connected to the stage judging unit, the first parameter can be selected when the gas discharge lamp is at a warm up stage, and the second parameter can be selected when the gas discharge lamp is at a constant power stage;

a corresponding control signal can be outputted to the control unit by the control signal output unit which is connected to the parameter selection unit, during the current commutation, based on the selected first or second parameter.

According to an embodiment of the gas discharge lamp circuit with improved crest factor in the invention, the result of comparison between said status signal and the preset value is a count signal of a counter.

A gas discharge lamp circuit with improved crest factor is also disclosed in the invention, it comprises an inverter, a decision signal sample circuit, a digital process chip, and a control unit, wherein:

the current or power of the gas discharge lamp can be controlled and the inversion of the direct current to the alternating current can be performed by the inverter; the decision signal of the gas discharge lamp can be sampled by the decision signal sample circuit which outputs a status signal;

whether the present state of the gas discharge lamp is at warm up stage or constant power stage can be judged by the digital process chip coupled to the decision signal sample circuit based on the result of comparison between the status signal and a preset value, the first parameter can be selected when the gas discharge lamp is at a warm up stage, and the second parameter can be selected when the gas discharge lamp is at a constant power stage, and a corresponding control signal can be outputted to the control unit during the current commutation based on the selected first or second parameter;

the crest factor of the gas discharge lamp can be improved by the control unit coupled to the digital process chip.

According to an embodiment of the gas discharge lamp circuit with improved crest factor in the invention, the gas discharge lamp circuit with improved crest factor comprises a power factor correction circuit, different alternating current input voltages are converted by the power factor correction circuit to constant or variable direct current, and the output of the power factor correction circuit is connected to the input of the inverter.

According to an embodiment of the gas discharge lamp circuit with improved crest factor in the invention, said status signal is a signal reflecting a duty cycle signal of the inverter.

According to an embodiment of the gas discharge lamp circuit with improved crest factor in the invention, the status signal is a signal reflecting the lamp state or signals reflecting the lamp power.

According to an embodiment of the gas discharge lamp circuit with improved crest factor in the invention, the digital process chip comprises a stage judging unit, a parameter selection unit and a control signal output unit, wherein:

whether the present stage of the gas discharge lamp is at the warm up stage or the constant power stage can be judged by the stage judging unit based on the result of comparison between the status signal and the preset value;

the first parameter can be selected by the parameter selection unit, which is connected to the stage judging unit, when the gas discharge lamp is at a warm up stage, and the second parameter can be selected when the gas discharge lamp is at a constant power stage;

a corresponding control signal can be outputted to the control unit by the control signal output unit, which is connected to the parameter selection unit, during the current commutation of the gas discharge lamp based on the selected first or second parameter.

According to another embodiment of the gas discharge lamp circuit with improved crest factor in the invention, the result of comparison between said status signal and the preset value is a count signal of a counter.

By comparing the above disclosure with the prior art, the beneficial effects are as follows: the disclosed technical scheme is that different parameters can be selected based on the stage of the gas discharge lamp (that is, at a warm up stage of constant current or at a constant power stage), and corresponding control signals can be outputted based on two different parameter so that the crest factor can be improved. By comparing with the prior art, different control parameters can mainly be used during different stages of the gas discharge lamp thereby more precise control can be realized.

DETAILED DESCRIPTION

Some implementations of the invention will be further described by incorporating the drawings and embodiments as follows.

Figure 1:
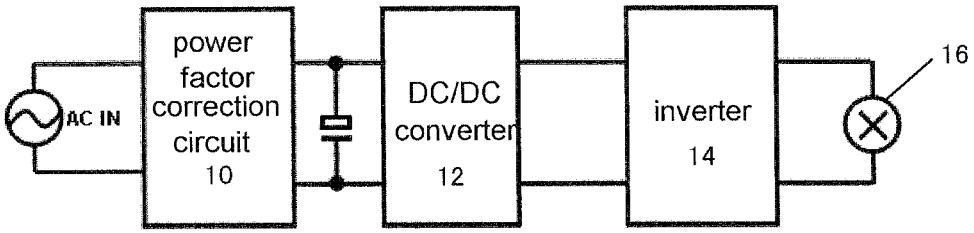
FIG. 1 is a principle diagram of a traditional gas discharge lamp.
Figure 2A:
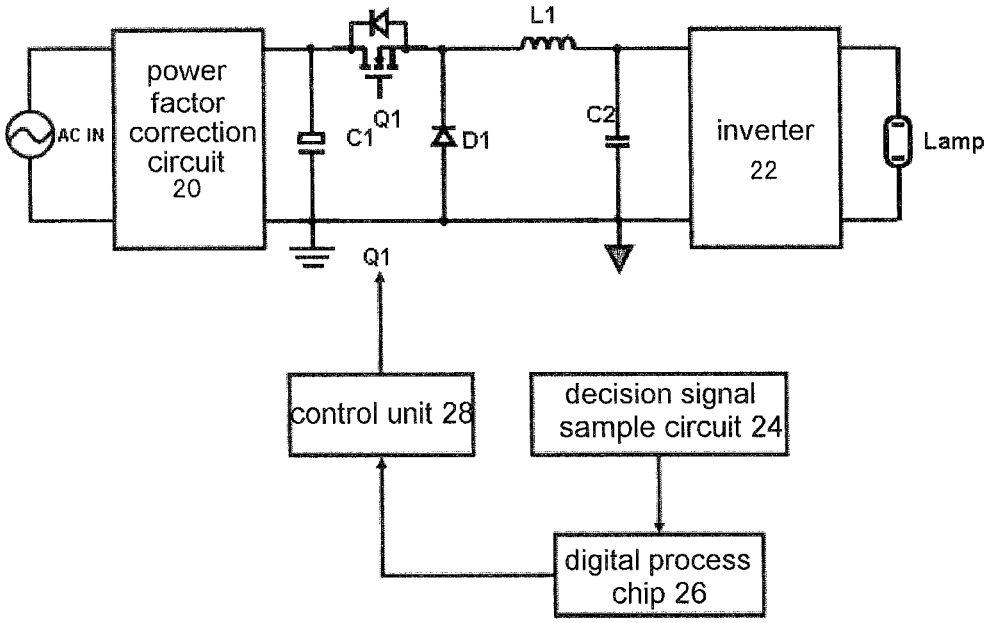
FIG. 2A is a principle diagram of the gas discharge lamp circuit with improved crest factor in the first embodiment of the invention.

The first embodiment of the gas discharge lamp circuit with improved crest factor The gas discharge lamp circuit with improved crest factor in the first embodiment of the invention is shown in FIG. 2A. Referring to FIG. 2A, the gas discharge lamp circuit in the embodiment comprises a power factor correction circuit 20, a DC/DC converter, an inverter 22, a decision signal sample circuit 24, a digital process chip 26 and a control unit 28.

The connection among these modules is: the input signal of the decision signal sample circuit 24 can be a signal reflecting the lamp state, such as the lamp voltage, duty cycle, or output voltage signal of the DC/DC converter, and the like, and it can also be a signal reflecting the lamp power, such as lamp power of the gas discharge lamp, system input power, or system output power, and the like, and it can also be a signal such as a count signal of the counter (wherein the counter also comprises a timer), and also other signals reflecting the lamp state. The input of the digital process chip 26 can be connected to the output of the decision signal sample circuit 24, the input of the control unit 28 can be connected to the output of the digital process chip 26. The output of the control unit 28 can be coupled to the DC/DC converter.

Usually, a boost circuit can be used in the power factor correction circuit 20, and other buck-boost circuit, flyback circuit, and the like can also be used therein, different input AC voltages can be converted to constant or variable DC voltages, and the waveform of the input current can be improved, the harmonics of the input current can be decreased, high power factor of the circuit can be realized, and the harmonic pollution on the grid can be reduced.

The control of the magnitude of the current or power of the lamp can be realized mainly by the DC/DC converter. During different stages after lighting the lamp, different magnitudes and waveforms of the lamp current or different magnitudes of the lamp power can be controlled by the DC/DC converter. The DC/DC converter can normally be the topology such as buck type, half bridge type, flyback type, and the like. The DC/DC converter in FIG. 2 is a buck converter.

The inversion of the direct current to the alternating current can be performed by the inverter 22. The inverter can be a topology of half bridge or other topology, such as whole bridge, and the like.

The signal of the gas discharge lamp can be sampled by the decision signal sample circuit 24. The signal sampled by the decision signal sample circuit 24 can be a signal reflecting the lamp state, for example, a signal reflecting the lamp voltage, such as the signals of the lamp voltage, duty cycle, or the output voltage of the DC/DC converter, and the like, also a signal reflecting the lamp power, such as the signal of the lamp power, system input power, system output power, and the like, also the count signal of the counter (wherein the counter also comprises a timer), and also other signals reflecting the lamp state.

The decision signal sample circuit 24 output a status signal by sampling the output voltage of the DC/DC converter as an example. The inverter 22 shown in FIG. 2A operates in an operation state of low frequency inversion, its output voltage is the lamp voltage, it is approximately the same as the output voltage of the DC/DC converter. So the state of the lamp voltage can be reflected by sampling output voltage of the DC/DC converter.

Figure 5:
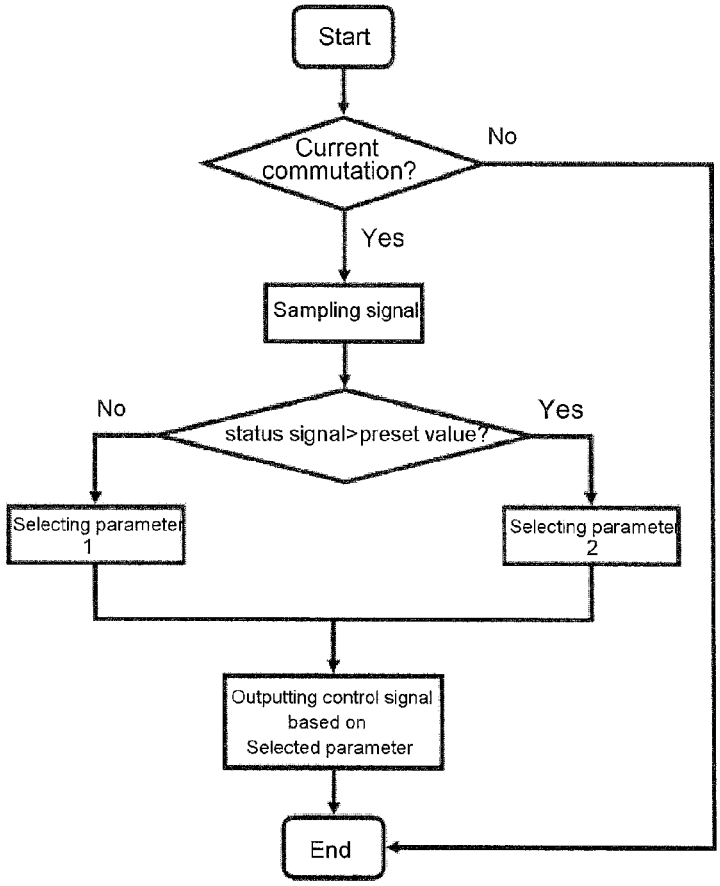
FIG. 5 is a control flowchart of the digital process chip in the invention.

Whether the present state of the gas discharge lamp is at the warm up stage or the constant power stage can be judged by the digital process chip 26 based on comparison between the status signal and the preset value, and the first parameter can be selected when the gas discharge lamp is at a warm up stage, and the second parameter can be selected when the gas discharge lamp is at a constant power stage, and a corresponding control signal can be outputted to the control unit 28 during the current commutation of the gas discharge lamp based on the selected first or second parameter. The specific operation procedure of the digital process chip 26 is shown in FIG. 5, the decision can be made based on the result of comparison, when it is required to commutate the lamp current, the first parameter can be used to output the first control signal to the control unit 28 when the voltage is lower than a preset value, and the second parameter can be used to output the second control signal to the control unit 28 when the voltage is higher than a preset value.

Figure 4:
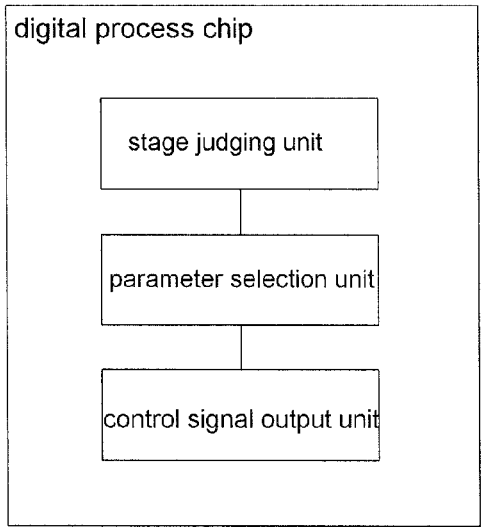
FIG. 4 is a detailed principle diagram of the digital process chip in the invention.

As shown in FIG. 4, the digital process chip comprises a stage judging unit, a parameter selection unit, and a control signal output unit, and these three units are connected in sequence.

Whether the present state of the gas discharge lamp is at the warm up stage or the constant power stage can be judged by the stage judging unit based on the result of comparison between the status signal and the preset value.

In the parameter selection unit, the first parameter can be selected when the gas discharge lamp is at a warm up stage, and the second parameter can be selected when the gas discharge lamp is at a constant power stage.

A corresponding control signal can be outputted to the control unit 28 by the control signal output unit during the current commutation based on the selected first or second parameter.

Figure 2B:
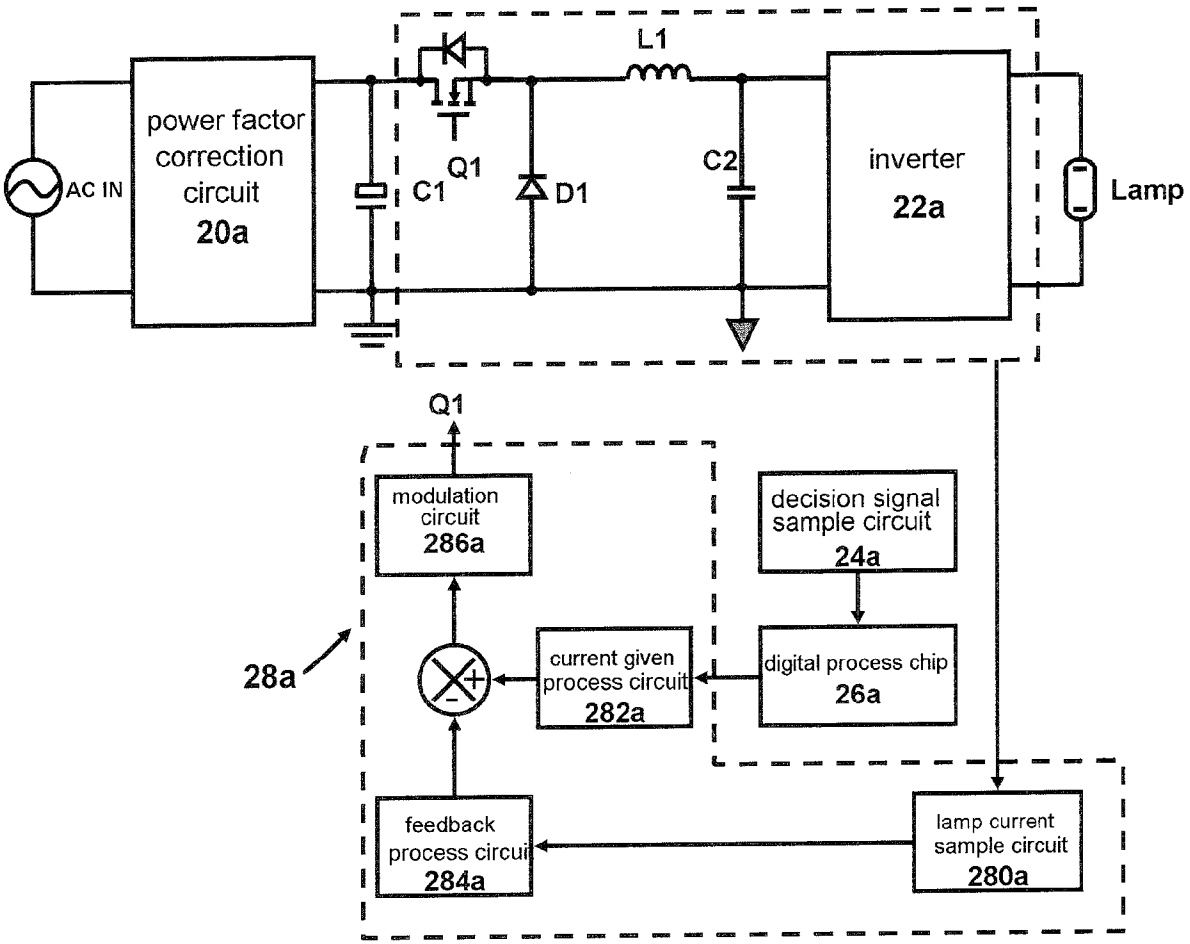
FIG. 2B is a detailed principle diagram of the embodiment in FIG. 2A.

The crest factor of the gas discharge lamp can be improved by the control unit 28 based on the control signal. One detail implementation is that, for example, the output current of the buck converter can be lowered down by varying the current given signal indicating outputted current of the control unit 28 or the feedback current signal. In one more detail embodiment, the control unit 28 can be controlled to switch between pause and restart to realize the switch of different current given signals. There illustrates two ways to implement the control unit 28, the control unit 28*a* in the first implementation is shown in FIG. 2B, the control unit 28*a* comprises a lamp current sample circuit 280*a*, a current given process circuit 282*a*, a feedback process circuit 284*a*, and a modulation circuit 286*a*.

Figure 2C:
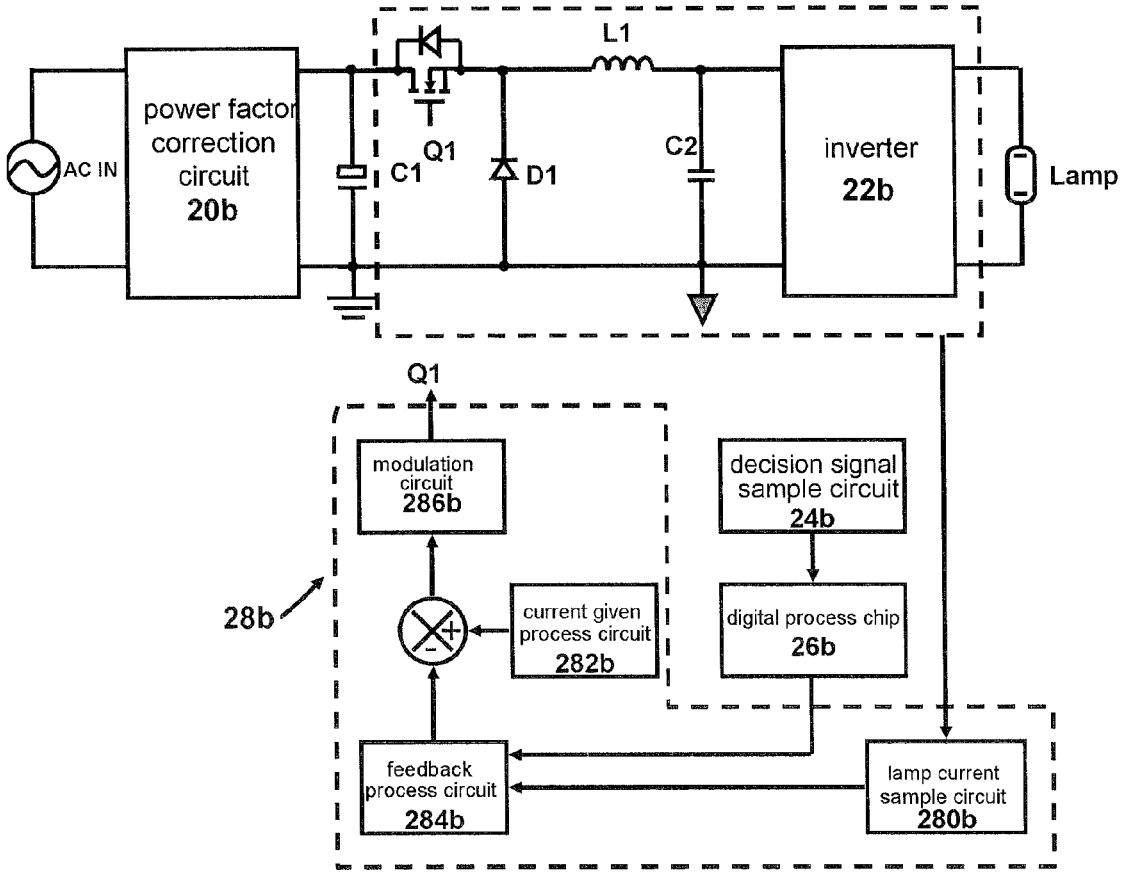
FIG. 2C is another detailed principle diagram of the embodiment in FIG. 2A.

First at all, the decision signal sample circuit 24*a* samples the signal reflecting the lamp state and output the decision signal, the digital process chip 26*a* receives the decision signal and processes it. The current given process circuit 282*a* receives the output of digital process chip 26*a* and outputs a current given signal which made the output of the circuit followed through the whole control loop. The control unit 28*b* of the second implementation is shown in FIG. 2C, the control unit 28*b* comprises a lamp current sample circuit 280*b*, a current given process circuit 282*b*, a feedback process circuit 284*b*, and a modulation circuit 286*b*.

First at all, the decision signal which is outputted by the decision signal sample circuit 24*b* is sent to the digital process chip 26*b* for processing. The output signal of the digital process chip 26*b* and the lamp current sample circuit are sent together to the feedback process circuit 284*b*, and a feedback signal can be outputted after processing.

Figure 3:
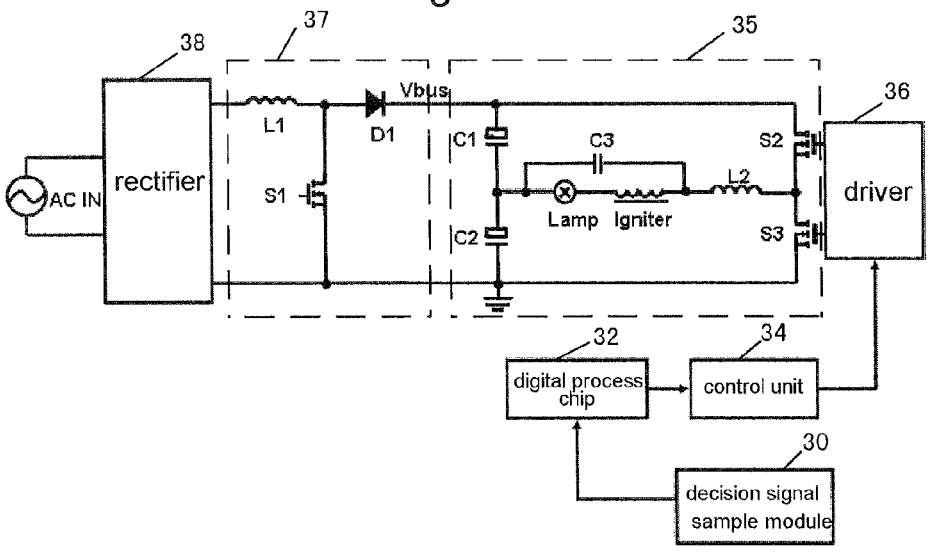
FIG. 3 is a principle diagram of the gas discharge lamp circuit with improved crest factor in the second embodiment of the invention.

The second embodiment of the gas discharge lamp circuit with improved crest factor The gas discharge lamp circuit with improved crest factor in the second embodiment of the invention is shown in FIG. 3. Referring to FIG. 3, the gas discharge lamp circuit in the embodiment comprises a rectifier 38, a power factor correction circuit 37, an inverter 35, a driver 36, a decision signal sample module 30, a digital process chip 32, and a control unit 34.

The connection among these modules is: the output of the decision signal sample module 30 can be connected to the input of the digital process chip 32, the output of the digital process chip 32 can be connected to the input of the control unit 34, and the output of the control unit 34 can be connected to the driver 36.

The rectifier 38 is used for rectifying the input AC voltage to a pulsating DC voltage.

The driver 36 is used for level converting the signal outputted from the control unit and for amplifying the signal drive ability to implement the control of the switches in the circuit.

Usually, a boost circuit can be used in the power factor correction circuit 37, and it can also be other buck-boost circuit, flyback circuit, and the like, different input AC voltages can be converted to constant or variable DC voltages, and the waveform of the input current can be improved, the harmonics of the input current can be decreased, high power factor of the circuit can be realized, and the harmonic pollution on the grid can be reduced.

The inverter 35 is used for inverting the direct current to the alternating current. The inverter can be a topology of half bridge or other topology such as whole bridge, and the like.

The signal of the gas discharge lamp reflecting the lamp state can be sampled by the decision signal sample module 30 and get a status signal. The status signal is, for example, a signal reflecting the lamp voltage, such as the signal of the lamp voltage, duty cycle, also a signal reflecting the lamp power, such as the signal of the lamp power, system input power, system output power, and the like, also the count signal of the counter (wherein the counter also comprises a timer), and also other signals reflecting the lamp state.

The decision signal sample module 30 will be further illustrated by taking sampling the duty cycle signal of the duty cycle as an example. A DC/DC converter of half bridge topology is shown in FIG. 3, because it is difficult to sample directly the lamp voltage of the half bridge topology, a low voltage signal, that is, a duty cycle signal, of the circuit is required to be sampled. There is a linear relationship between the duty cycle signal and the output voltage in the circuit, shown as follows:

$$\text{Lamp voltage}=(\text{duty}-0.5)\times V\text{bus},$$

Because the voltage Vbus outputted by PFC circuit is normally fixed, for example, 450V, so the lamp voltage state can also be reflected by the duty cycle signal.

Whether the present state of the gas discharge lamp is at the warm up stage or the constant power stage can be judged by the digital process chip 32 based on the result of comparison between its input signal and a preset value, and the first parameter can be selected when the gas discharge lamp is at a warm up stage, and the second parameter can be selected when the gas discharge lamp is at a constant power stage, and a corresponding control signal can be outputted to the control unit 34 during the current commutation of the gas discharge lamp based on the selected first or second parameter. The specific operation procedure of the digital process chip 32 is shown in FIG. 5, based on its input signal, when it is required to commutate the lamp current, the first parameter can be used to output the first control signal to the control unit 34 under the condition that its input signal is lower than the preset value, or the second parameter can be used to output the second control signal to the control unit 34 under the condition that its input signal is higher than the preset value.

As shown in FIG. 4, the digital process chip comprises a stage judging unit, a parameter selection unit, and a control signal output unit, and these three units are connected in sequence.

Whether the present state of the gas discharge lamp is at the warm up stage or the constant power stage can be judged by the stage judging unit based on the comparison between its input signal and the preset value.

In the parameter selection unit, the first parameter can be selected when the gas discharge lamp is at a warm up stage, and the second parameter can be selected when the gas discharge lamp is at a constant power stage.

A corresponding control signal can be outputted to the control unit 34 by the control signal output unit during the current commutation of the gas discharge lamp based on the selected first or second parameter.

The crest factor of the gas discharge lamp can be improved by the control unit 34 based on the control signal. One detail implementation is that, for example, the control unit 34 can cause the output current of the half bridge converter to trend down by varying the given signal of the outputted current of the control unit 34 or the feedback signal of the sampled current. In one more detail embodiment, the control unit 34 can be controlled to switch between pause and restart to realize the switch of different feedback current signals.

Figure 6:
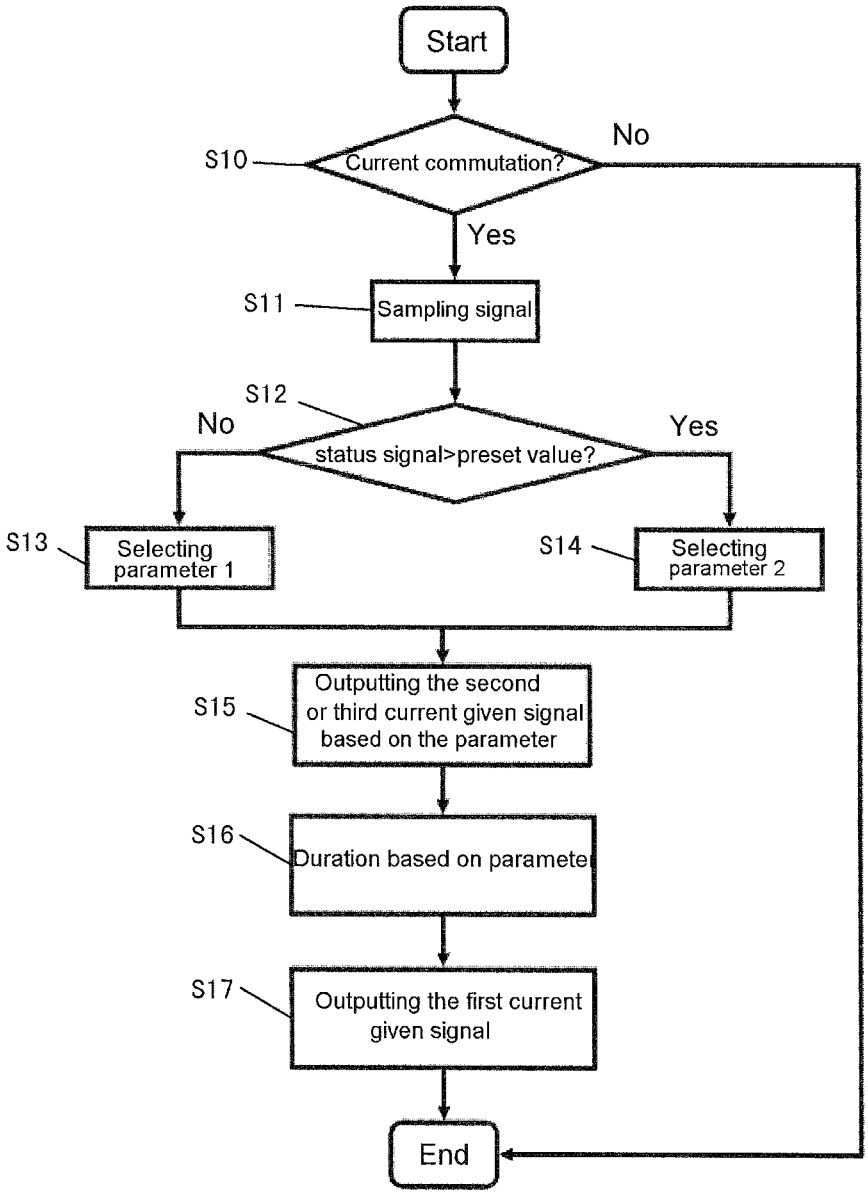
FIG. 6 is a flowchart of a method for improving the crest factor of the gas discharge lamp in the first embodiment of the invention.

The first embodiment of the method for improving the crest factor in the gas discharge lamp The flowchart of the first embodiment of the method for improving the crest factor in the gas discharge lamp is shown in FIG. 6. Referring to FIG. 6, the respective steps of the method in the embodiment will be described in detail as follows. The physical circuit corresponding to the embodiment is shown in FIG. 2B. The circuit shown in FIG. 2B can be used as a fundamental of the implementation, and please referring to the following steps.

Step S10: judging whether the current is commutated or not, if the current is commutated, then the process will proceed to Step S11, otherwise it will be the end of the process.

Step S11: sampling the signal of the gas discharge lamp to get a status signal. The status signal can be a signal reflecting the lamp state, for example, a signal reflecting the lamp voltage, such as the signals of the lamp voltage, duty cycle, and the like, also a signal reflecting the lamp power, such as the signal of the lamp power, system input power, system output power, also a count signal of the counter (wherein the counter also comprises a timer), and also other signals reflecting the lamp state.

Step S12: comparing the status signal with a preset value. Based on the result of comparison, Step13 or Step14 is selected. For example, if the signal is larger than the preset value, then the process will proceed to Step S14, otherwise, the process will proceed to Step S13.

In the present step, practically, whether the present state of the gas discharge lamp is at the warm up stage or the constant power stage is judged by the result of comparison between the status signal and the preset value.

Since the gas discharge lamp comprises mainly two time periods, that is, the warm up stage and the constant power stage, the methods of adjustment are different for these two stages, therefore these two stages are processed respectively.

Step S13: selecting the first parameter. The first parameter can be selected when it is obtained that the gas discharge lamp is at warm up stage currently.

Step S14: selecting the second parameter. The second parameter can be selected when it is obtained that the gas discharge lamp is at constant power stage currently.

Step S15: outputting the second or the third current given signal based on the selected first or second parameter, that is, the second current given signal corresponding to the first parameter, and the third current given signal corresponding to the second parameter.

Step S16: holding the status of outputting the second or the third current given signal for the duration of the selected first or second parameter, wherein the durations of the current given signals of the first and second parameters can be different or the same.

Step S17: the first current given signal can be outputted when the duration of the second or third current given signal is over.

According to the received current given signal, the lamp current can be adjusted under the control of current adjustment loop which contains the feedback current signal of the lamp current. The second current given signal and the third current given signal can be the same or different. The duration is used mainly for controlling respective proportion of different current given signals in one calculated cycle, for example, the proportion of the first or second current given signal in one calculated cycle, or the proportion of the first or third current given signal in one calculated cycle. The current waveform of the lamp current during current commutation can be adjusted under control by suitable proportion and suitable current given signal. Thereby the crest factor can be improved.

Figure 10A:
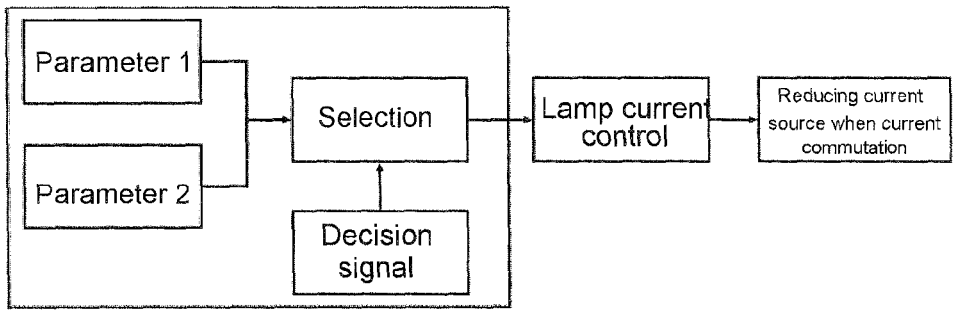
FIG. 10A is a schematic diagram of reduction current source of the invention.
Figure 10B:
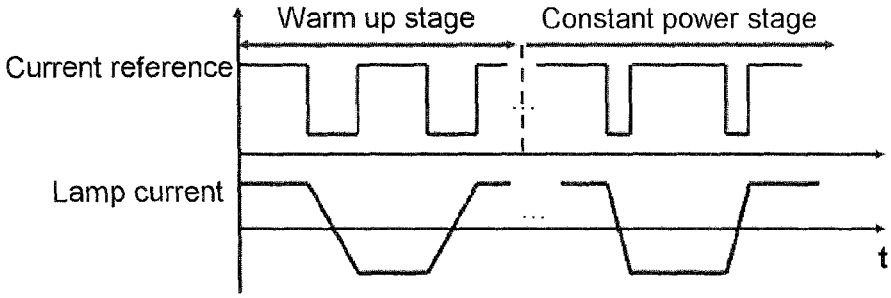
FIG. 10B is a schematic diagram of the control signal waveform corresponding to FIG. 10A.

The principle of the embodiment corresponds to FIG. 10A, the parameter 1 or 2 is selected based on the lamp state, and the current source can be reduced during the current commutation based on the parameter 1 or 2, and the relationship between the current signals is shown in FIG. 10B.

Figure 7:
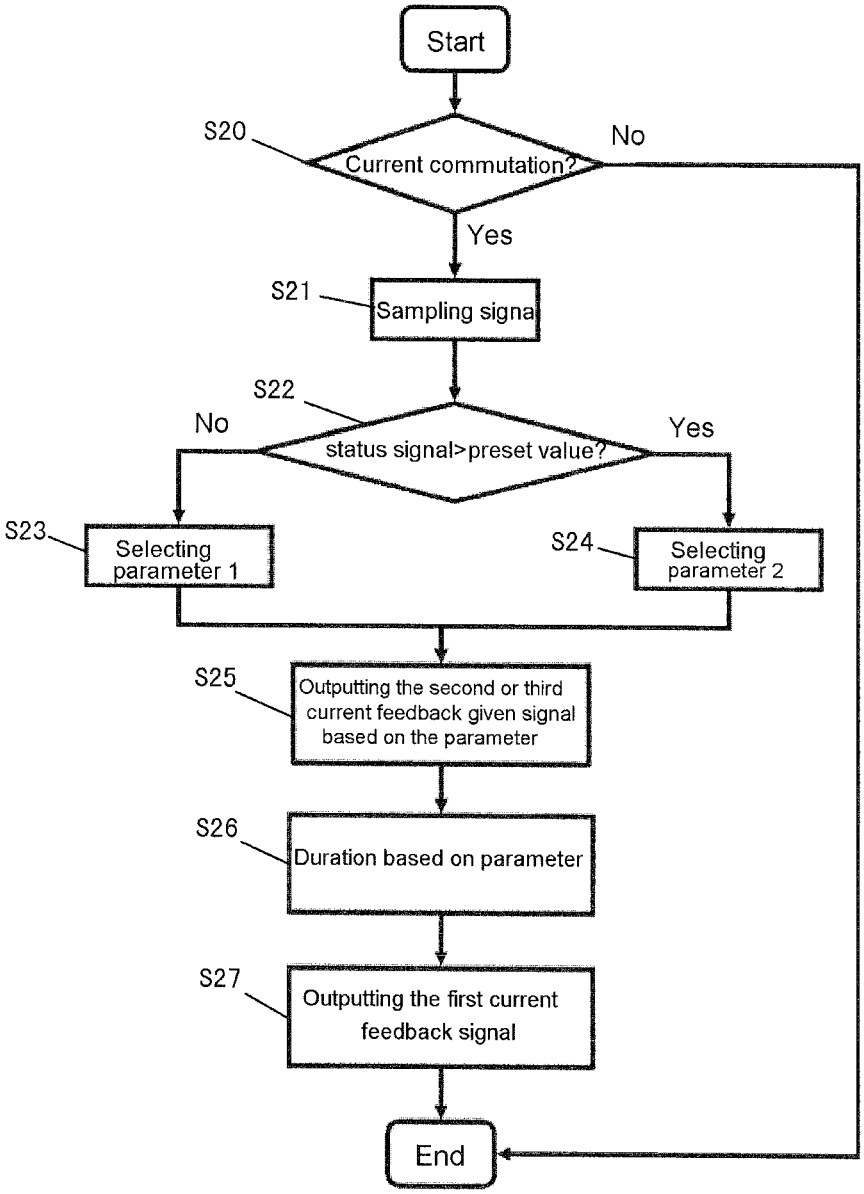
FIG. 7 is a flowchart of a method for improving the crest factor of the gas discharge lamp in the second embodiment of the invention.

The second embodiment of the method for improving the crest factor in the gas discharge lamp The flowchart of the second embodiment of the method for improving the crest factor in the gas discharge is shown in FIG. 7. Referring to FIG. 7, the respective steps of the method in the embodiment will be described in detail as follows. The physical circuit corresponding to the embodiment is shown in FIG. 2C. The circuit shown in FIG. 2C can be used as a fundamental of the implementation, and please referring to the following steps.

Step S20: judging whether the current is commutated or not, if the current is commutated, then the process will proceed to Step S21, otherwise, it will be the end of the process.

Step S21: sampling the signal of the gas discharge lamp to get a status signal.

The status signal can be a signal reflecting the lamp state, for example, a signal reflecting the lamp voltage, such as the signals of the lamp voltage, duty cycle, and the like, also a signal reflecting the lamp power, such as the signal of the lamp power, system input power, system output power, and the like, also a count signal of the counter (wherein the counter also comprises a timer), and also other signals reflecting the lamp state.

Step S22: comparing the status signal with a preset value. Based on the result of comparison, Step23 or Step24 is selected. For example, if the signal is larger than the preset value, then the process will proceed to Step S24, otherwise, the process will proceed to Step S23.

In the present step, practically, whether the present state of the gas discharge lamp is at the warm up stage or the constant power stage is judged by the result of comparison between the status signal and the preset value.

Since the gas discharge lamp comprises mainly two time periods, that is, warm up stage and constant power stage, the methods of adjustment are different for these two stages, therefore these two stages are processed respectively.

Step S23: selecting the first parameter. The first parameter can be selected when it is obtained that the gas discharge lamp is at warm up stage currently.

Step S24: selecting the second parameter. The second parameter can be selected when it is obtained that the gas discharge lamp is at constant power stage currently.

Step S25: outputting the second or the third current feedback signal based on the selected first or second parameter, that is, the second current feedback signal corresponding to the first parameter, and the third current feedback signal corresponding to the second parameter.

Step S26: holding the status of outputting the second or the third current feedback signal for duration of the selected first or second parameter, wherein the durations of the current feedback signals of the first and second parameters can be different or the same.

Step S27: the first current feedback signal can be outputted when the duration of the second or third current feedback signal is over.

According to the received current feedback signal, the lamp current in the system can be adjusted by the current adjustment loop which has current given signal. The second current feedback signal and the third current feedback signal can be the same or different. The duration is used mainly for controlling the respective proportion of different current feedback signals in one calculated cycle, for example, the proportion of first or second current feedback signal in one calculated cycle, or the proportion of first or third current feedback signal in one calculated cycle. The current waveform of the lamp current during current commutation can be adjusted by suitable proportion and suitable current feedback signal. Thereby the crest factor can be improved.

Figure 8:
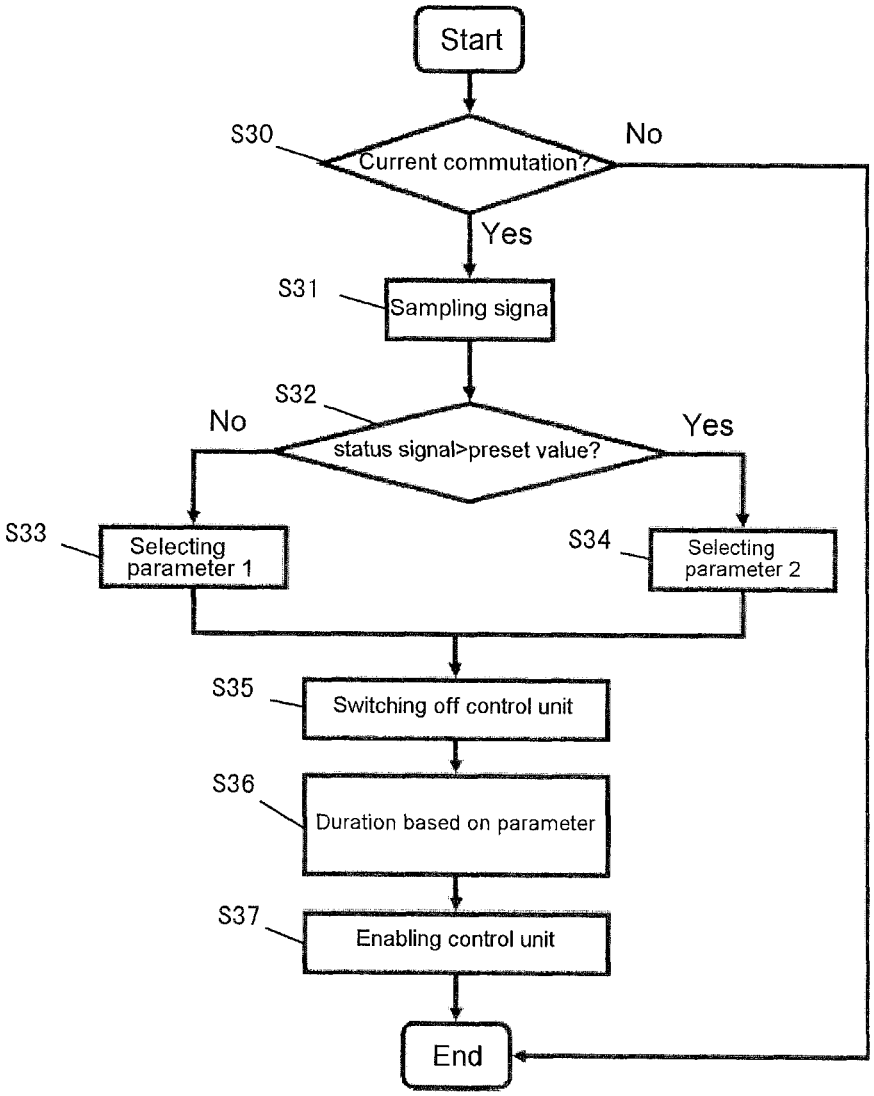
FIG. 8 is a flowchart of a method for improving the crest factor of the gas discharge lamp in the third embodiment of the invention.

The third embodiment of the method for improving the crest factor in the gas discharge lamp The flowchart of the third embodiment of the method for improving the crest factor in the gas discharge lamp in the invention is shown in FIG. 8. Referring to FIG. 8, the respective steps of the method in the embodiment will be described in detail as follows.

Step S30: judging whether the current is commutated or not, if the current is commutated, then the process will proceed to Step S31, otherwise, it will be the end of the process.

Step S31: sampling the decision signal of the gas discharge lamp to get a status signal.

The status signal can be a signal reflecting the lamp state, for example, a signal reflecting the lamp voltage, such as the signals of the lamp voltage, duty cycle, and the like, also a signal reflecting the lamp power, such as the signals of the lamp power, system input power, system output power, and the like, also a count signal of the counter (wherein the counter also comprises a timer), and also other signals reflecting the lamp state.

Step S32: comparing the status signal with a preset value. Based on the result of comparison, Step33 or Step34 is selected. For example, if the signal is larger than the preset value, than the process will proceed to Step S34, otherwise, the process will proceed to Step S33.

In the present step, practically, whether the present state of the gas discharge lamp is at the warm up stage or the constant power stage is judged by the result of comparison between the status signal and the preset value.

Since the gas discharge lamp comprises mainly two time periods, that is, warm up stage and constant power stage, the methods of adjustment are different for these two stages, therefore these two stages are processed respectively.

Step S33: selecting the first parameter. The first parameter can be selected when it is obtained that the gas discharge lamp is at warm up stage currently.

Step S34: selecting the second parameter. The second parameter can be selected when it is obtained that the gas discharge lamp is at constant power stage currently.

Step S35: turning off the control unit, that is, the DC/DC converter in the gas discharge lamp circuit is disabled.

Step S36: holding the control unit disabled for the duration of the selected first or second parameter, wherein the durations of disabling the control unit by the first and second parameters can be different or the same.

Step S37: enabling the control unit, that is, the DC/DC converter in the gas discharge lamp circuit is enabled when the duration of disabling the control unit is over.

Figure 9A:
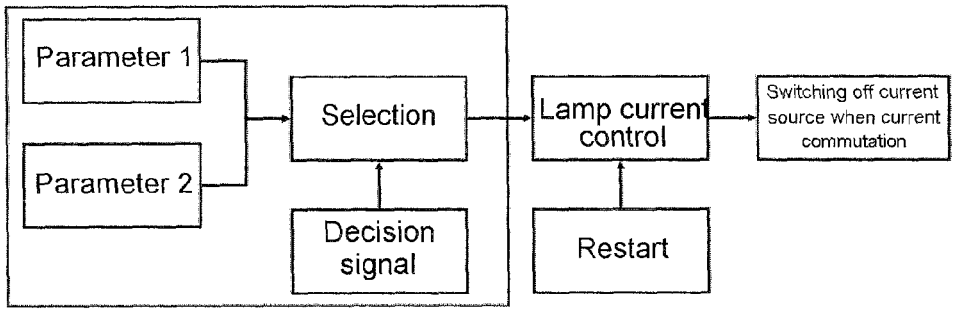
FIG. 9A is a schematic diagram of a disable/enable current source of the invention.
Figure 9B:
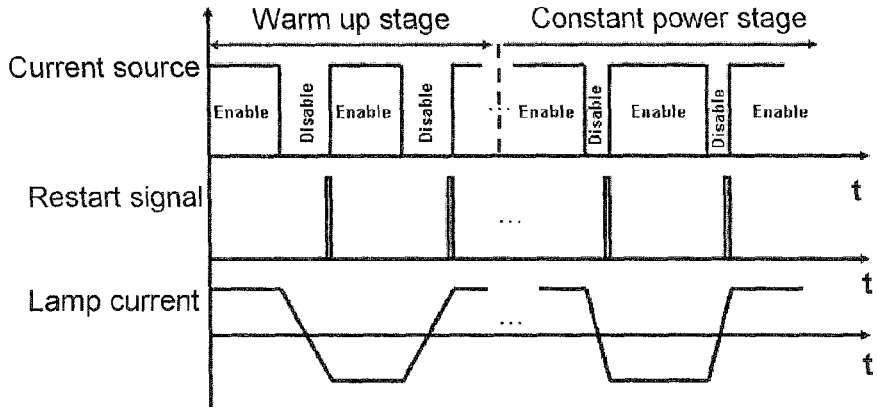
FIG. 9B is a schematic diagram of the control signal waveform corresponding to FIG. 9A.

Referring to FIG. 9A for the implementation principle corresponding to the steps of the embodiment, the parameter 1 or parameter 2 can be selected based on the lamp state (for example, the parameter 1 can be selected when the lamp state indicates that the gas discharge lamp is at warm up stage, and the parameter 2 can be selected when the lamp state indicates that the gas discharge lamp is at constant power stage). The current source may be switched off under control during the lamp current commutation, and it will be restarted under the function of the restart signal, the signal schematic diagram is shown in FIG. 9B.

The above embodiments are provided for those skilled in the ordinary technology of the art to implement or use the invention, various modifications or changes can be made by those skilled in the ordinary technology without departing the inventive idea of the invention, thus, the protection scope of the invention is not limited by the above embodiments, rather, it should conform with the maximum range of the innovative features mentioned in the claims.

What is claimed is:

1. A method for improving the crest factor of a gas discharge lamp, comprising:

step 1: sampling a signal of the gas discharge lamp to get a status signal;

step 2: judging whether a present stage of the gas discharge lamp is at a warm up stage or a constant power stage based on a result of comparison between the said status signal and a preset value;

step 3: selecting preset parameters based on the stage of the gas discharge lamp, wherein a first parameter is selected when the gas discharge lamp is at the warm up stage, and a second parameter is selected when the gas discharge lamp is at the constant power stage;

step 4: outputting a control signal during the lamp current commutation based on the selected first or second parameter to improve the crest factor of the gas discharge lamp, wherein said step 4 comprises:

disabling a DC/DC converter in the gas discharge lamp circuit;

holding the DC/DC converter disabled for duration of the selected first or second parameter; and enabling the DC/DC converter when the duration of disabling the DC/DC converter is over.

2. The method for improving the crest factor of the gas discharge lamp in claim 1, wherein said status signal is a signal reflecting the lamp state or a signal reflecting the lamp power.

3. The method for improving the crest factor of the gas discharge lamp in claim 2, wherein said signal reflecting the lamp state is one of lamp voltage and duty cycle, or said signal reflecting the lamp power is one of the lamp power of the gas discharge lamp, system input power and system output power.

4. The method for improving the crest factor of the gas discharge lamp in claim 1, wherein the result of comparison between said status signal and the preset value is a count signal of a counter.

5. A gas discharge lamp circuit with improved crest factor, comprising a DC/DC converter, an inverter, a decision signal sample circuit, a digital process chip and a control unit, wherein:

a current or power of the gas discharge lamp is controlled by said DC/DC converter;

inversion of the direct current to the alternating current is performed by said inverter, which is coupled to said DC/DC converter;

a signal of the gas discharge lamp is sampled by said decision signal sample circuit which outputs a status signal;

whether a present state of the gas discharge lamp is at a warm up stage or a constant power stage is judged by said digital process chip, which is coupled to said decision signal sample circuit, based on the result of comparison between the status signal and a preset value, wherein a first parameter is selected when the gas discharge lamp is at the warm up stage, and a second parameter is selected when the gas discharge lamp is at the constant power stage, and a corresponding control signal is outputted to the control unit during the current commutation based on the selected first or second parameter;

the crest factor of the gas discharge lamp is improved by said control unit which is coupled to said digital process chip, which comprises disabling a DC/DC converter in the gas discharge lamp circuit, holding the DC/DC converter disabled for duration of the selected first or second parameter, and enabling the DC/DC converter when the duration of disabling the DC/DC converter is over.

6. The gas discharge lamp circuit with improved crest factor in claim 5, further comprising a power factor correction circuit, different input alternating voltages can be converted to constant or variable direct current by said power factor correction circuit, the output of said power factor correction circuit can be coupled to the input of said DC/DC converter.

7. The gas discharge lamp circuit with improved crest factor in claim 5, wherein said status signal is a signal reflecting the lamp state or a signal reflecting the lamp power.

8. The gas discharge lamp circuit with improved crest factor in claim 5, wherein said status signal is the signal reflecting the output voltage of said DC/DC converter.

9. The gas discharge lamp circuit with improved crest factor in claim 5, wherein said digital process chip comprises a stage judging unit, a parameter selection unit and a control signal output unit, wherein:

whether the present state of the gas discharge lamp is at the warm up stage or the constant power stage is decided by the stage judging unit based on the result of comparison between the status signal and the preset value;

said parameter selection unit is connected to said stage judging unit, the first parameter is selected when the gas discharge lamp is at the warm up stage, and the second parameter is selected when the gas discharge lamp is at the constant power stage;

a corresponding control signal is outputted to the control unit by said control signal output unit which is connected to said parameter selection unit, during the current commutation, based on the selected first or second parameter.

10. The gas discharge lamp circuit with improved crest factor in claim 7, wherein the result of comparison between said status signal and the preset value is a count signal of a counter.

11. A gas discharge lamp circuit with improved crest factor, comprising an inverter, a decision signal sample circuit, a digital process chip, and a control unit, wherein:

the current or power of the gas discharge lamp is controlled and the inversion of the direct current to the alternating current is performed by the inverter;

the signal of the gas discharge lamp is sampled by the decision signal sample circuit which outputs a status signal;

whether the present state of the gas discharge lamp is at a warm up stage or a constant power stage is judged by the digital process chip coupled to the decision signal sample circuit based on the result of comparison between the status signal and a preset value, wherein the first parameter is selected when the gas discharge lamp is at the warm up stage, and the second parameter is selected when the gas discharge lamp is at the constant power stage, and a corresponding control signal is outputted to the control unit during the current commutation based on the selected first or second parameter;

the crest factor of the gas discharge lamp is improved by the control unit coupled to the digital process chip, which comprises disabling a DC/DC converter in the gas discharge lamp circuit, holding the DC/DC converter disabled for duration of the selected first or second parameter, and enabling the DC/DC converter when the duration of disabling the DC/DC converter is over.

12. The gas discharge lamp circuit with improved crest factor in claim 11, further comprising a power factor correction circuit, wherein different alternating current input voltages are converted by said power factor correction circuit to constant or variable direct current, and the output of said power factor correction circuit is connected to the input of said inverter.

13. The gas discharge lamp circuit with improved crest factor in claim 11, wherein said status signal is a signal reflecting a duty cycle signal of said inverter.

14. The gas discharge lamp circuit with improved crest factor in claim 11, wherein said status signal is a signal reflecting the lamp state or signals reflecting the lamp power.

15. The gas discharge lamp circuit with improved crest factor in claim 11, wherein said digital process chip comprises a stage judging unit, a parameter selection unit and a control signal output unit, wherein:

whether the present stage of the gas discharge lamp is at the warm up stage or the constant power stage is judged by said stage judging unit based on the result of comparison between the status signal and the preset value;

the first parameter is selected by the parameter selection unit, which is connected to the stage judging unit, when the gas discharge lamp is at the warm up stage, and the second parameter is selected when the gas discharge lamp is at the constant power stage;

a corresponding control signal is outputted to the control unit by the control signal output unit, which is connected to the parameter selection unit, during the current commutation of the gas discharge lamp based on the selected first or second parameter.

16. The gas discharge lamp circuit with improved crest factor in claim 11, wherein the result of comparison between said status signal and the preset value is a count signal of a counter.

* * * * *